US006767108B1

(12) United States Patent
Blachowski et al.

(10) Patent No.: US 6,767,108 B1
(45) Date of Patent: Jul. 27, 2004

(54) NON-LETHAL FLASH GRENADE

(75) Inventors: Thomas J. Blachowski, Alexandria, VA (US); Phillip R. Sturgill, Alexandria, VA (US); David A. Culhane, Port Tobacco, MD (US); Peter P. Ostrowski, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/318,672

(22) Filed: Dec. 10, 2002

(51) Int. Cl.[7] ..... F41G 1/34

(52) U.S. Cl. ..... 362/112; 362/113; 362/251; 315/56; 315/58

(58) Field of Search ..... 362/11, 112, 113, 362/110, 251, 227, 15, 4, 6, 13–14; 102/498; 89/1.11; 315/57, 56, 58, 149

(56) References Cited

U.S. PATENT DOCUMENTS

| | | | | | |
|---|---|---|---|---|---|
| 3,312,086 | A | * | 4/1967 | Casebeer et al. | 431/14 |
| 3,518,417 | A | * | 6/1970 | Bertrams | 362/11 |
| 3,665,200 | A | * | 5/1972 | Zaubitzer | 250/214 SW |
| 3,846,746 | A | * | 11/1974 | Trageser et al. | 340/961 |
| 4,147,497 | A | * | 4/1979 | Haraden | 431/359 |
| 4,932,328 | A | | 6/1990 | Pinkney et al. | 102/482 |
| 4,976,201 | A | | 12/1990 | Hamilton | 102/323 |
| 5,654,523 | A | | 8/1997 | Brunn | 102/498 |
| 6,253,680 | B1 | | 7/2001 | Grubelich | 102/334 |
| 2002/0108526 | A1 | * | 8/2002 | Wes et al. | 102/482 |

* cited by examiner

*Primary Examiner*—Stephen Husar
*Assistant Examiner*—Sharon Payne
(74) *Attorney, Agent, or Firm*—Mark Homer

(57) ABSTRACT

A non-lethal flash grenade includes a transparent, generally cylindrical housing; a layer of flash lamps disposed in the housing; an ignition circuit connected to a first centrally located flash lamp in the layer of flash lamps; a battery connected to the ignition circuit; and a variable time delay switch connected to the ignition circuit; whereby the first centrally located flash lamp is activated by the ignition circuit and remaining flash lamps are sympathetically activated by a flash of the first centrally located flash lamp.

14 Claims, 3 Drawing Sheets

NON-LETHAL FLASH GRENADE

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates to diversionary devices used in a wide variety of military, law-enforcement, training and demonstration scenarios. More particularly, the invention is used to produce a disorienting flash of light to temporarily incapacitate or disorient adversaries without inflicting permanent damage.

In hostage situations or others where active distractions are necessary, a flash generating device may be implemented. It is critical that the flash generating device be non-lethal to all hostages or other non-combatants, while effectively distracting or disabling the perpetrators. It is also highly desirable that the device does not contain any explosives or energetic materials, is safe to handle and transport, and is incapable of generating shrapnel, thereby minimizing collateral damage to persons or property not affected by the situation.

U.S. Patent Publication 2002/0108526 discloses a launchable, multi-sensory distraction grenade including a base, three outer grenade walls arranged together on the base to pivotally move from a first position, to a second position, extending outward laterally from the base in different directions, to form lateral legs to support the base after it lands on a surface, a plurality of spring fingers retaining the walls in contact with the base, at least two distraction devices mounted in the grenade for initiating an extended period of personnel distraction in the area of the grenade with its walls in their second position, a distraction device ignitor and safety trigger at least a portion of which is external the casing for controlling the ignition means.

U.S. Pat. No. 6,253,680 shows a diversionary device with a housing having at least one opening and containing a non-explosive propellant and a quantity of fine powder packed within the housing, with the powder being located between the propellant and the opening. When the propellant is activated, it has sufficient energy to propel the powder through the opening to produce a cloud of powder outside the housing. An igniter is also provided for igniting the cloud of powder to create a diversionary flash and bang, but at a low enough pressure to avoid injuring nearby people.

U.S. Pat. No. 5,654,523 discloses a stun grenade for generating an explosion accompanied by light and/or blaring sound. The stun grenade comprises a housing having a body, a base and a cover defining an interior cavity housing a cartridge containing an explosive charge. A plurality of vents are defined in the housing, and a defining wall of each vent is angularly offset from the longitudinal axis of the cavity for discharging explosive energy radially outwardly from the grenade. The stun grenade also includes a bore for facilitating the releasable securement of a variety of attachments, such as a clamp and a tear gas container.

U.S. Pat. No. 4,932,328 relates to a stun grenade including a steel housing having a steel tubular body with steel end members brazed to the ends of the tubular body, and a brass collar member threadably received in a threaded central opening in one of the end members for supporting an explosive charge in the housing. At the inner end of the collar member is a cylindrical portion to which a tubular container filled with the explosive charge is attached. The outer diameter of the tubular container is less than the minimum diameter of the threaded opening in the one end member to permit the tubular container to be inserted through the threaded opening while attached to the collar member. At the outer end of the collar member is a threaded recess for threaded receipt of a fuse member externally of the housing. A flash hole in the collar member directs a flash which is produced when the fuse member is activated into the tubular container to ignite the explosive charge.

U.S. Pat. No. 4,976,201 discloses a distraction device comprised of a hollow container that is divided into a first chamber and a second chamber. An explosive charge capable of producing a loud sound and a brilliant flash of light fills the second chamber. A standard M201 hand grenade fuse is installed in the distraction device so that the fuse is in communication with the first chamber. The fuse initiates the sequential ignition of several combustible compositions in the distraction device.

All of these devices have a common feature that leads to a common problem: their explosive output is caused by an energetic or explosive material that has sufficient force to cause serious bodily injury if they go off accidentally.

SUMMARY OF THE INVENTION

It is an object of the invention to provide a non-lethal flash grenade that does not cause permanent eye damage, does not generate lethal sound levels and does not create harmful shrapnel.

Further objects, features, and advantages of the invention will become apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The non-lethal flash grenade of the present invention utilizes commercially available flashlamps to generate light output without the potential for harmful or lethal side effects. An important feature of the invention is the ability of a single flashlamp to very rapidly sympathetically initiate other flashlamps held in close proximity. Therefore, the electrical power supply (the battery and firing circuit) is very small and can easily be packaged for a hand-held device.

Figure 1:
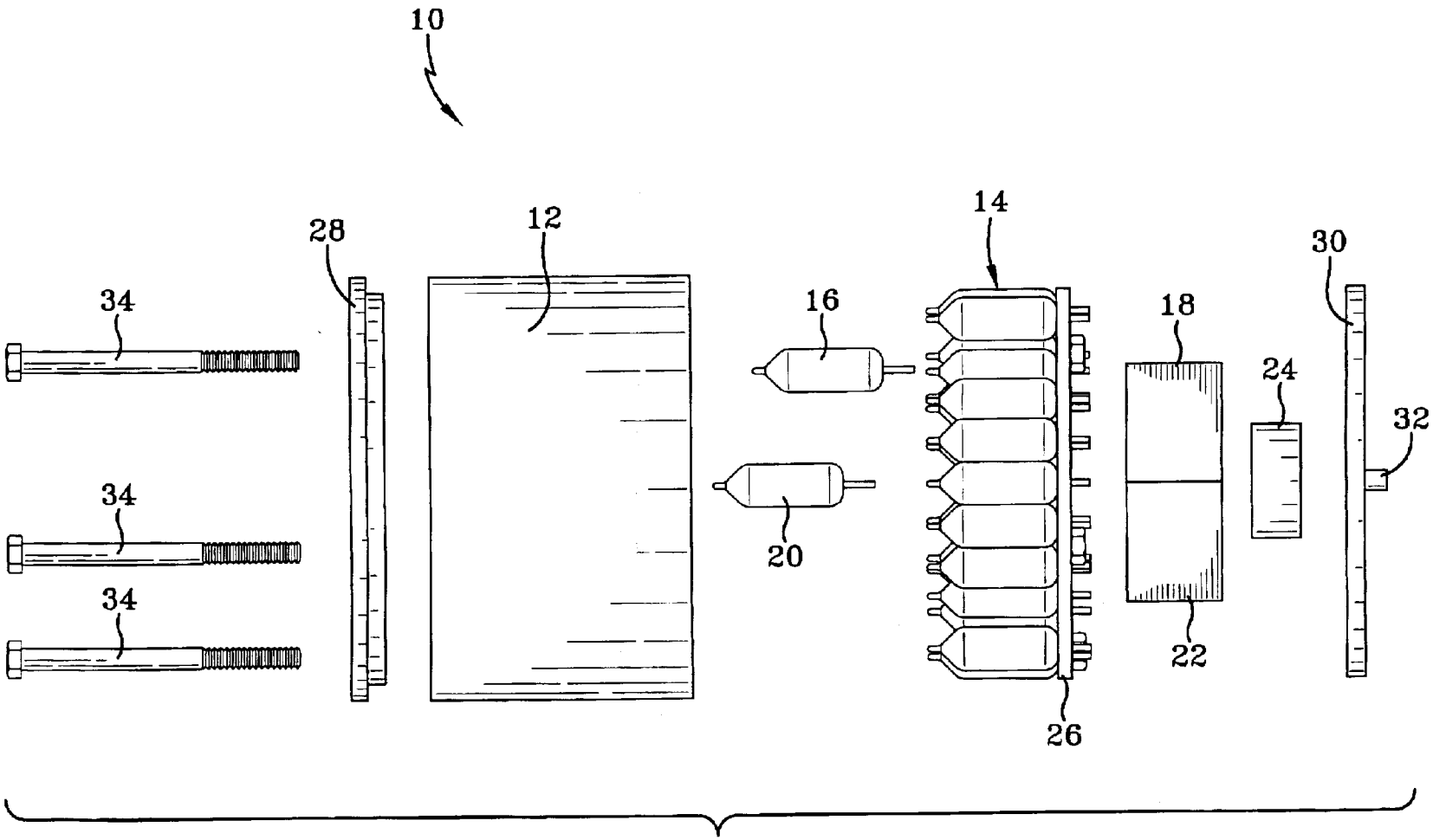
FIG. 1 is an exploded side view of one embodiment of the invention.
Figure 2:
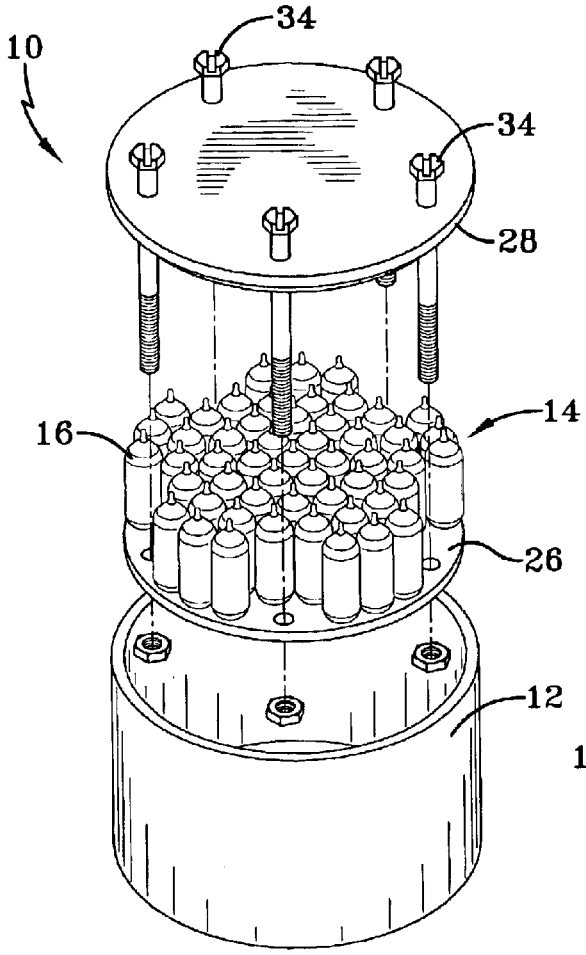
FIG. 2 is an exploded perspective view of the embodiment of FIG. 1.
Figure 4:
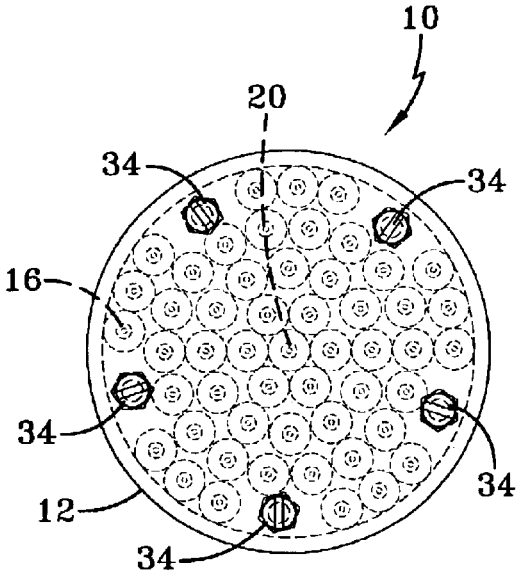
FIG. 4 is a top view of the embodiment of FIG. 1.
Figure 3:
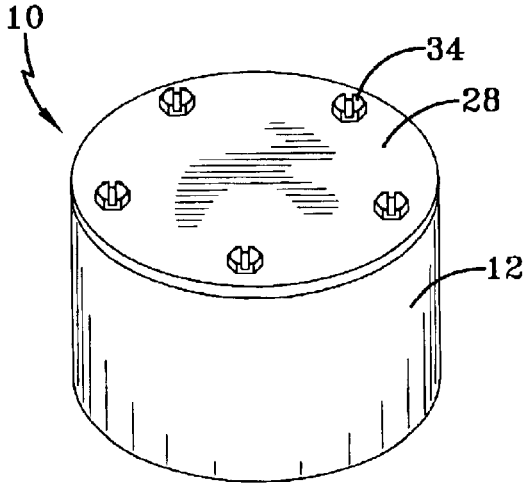
FIG. 3 is an assembled perspective of the embodiment of FIG. 1.

FIG. 1 is an exploded side view of one embodiment of a non-lethal flash grenade 10 according to the invention. FIG. 2 is an exploded perspective view of the embodiment of FIG. 1. FIG. 3 is an assembled perspective of the embodiment of FIG. 1. FIG. 4 is a top view of the embodiment of FIG. 1. Referring to FIGS. 1–4, non-lethal flash grenade 10 includes a transparent, generally cylindrical housing 12, a layer 14 of flash lamps 16 disposed in the housing 12, an ignition circuit 18 connected to a centrally located flash lamp 20 (see FIG. 4) in the layer 14 of flash lamps 16, a battery 22 connected to the ignition circuit 18 and a variable time delay switch 24 connected to the ignition circuit 18. The centrally located flash lamp 20 (ignition lamp) is activated by the ignition circuit 18. The remaining flash lamps 16 are sympathetically activated by the flash of the centrally located flash lamp 20.

Housing 12 is made of, for example, polycarbonate. Flash lamps 16 are of the zirconium wool and oxygen type and are commercially available. Battery 22 is, for example, a six volt battery. The variable time delay switch (or trigger) 24 includes delay times ranging from 0.125 seconds to over 5.0 minutes depending on the setting selected by the user.

Figure 6:
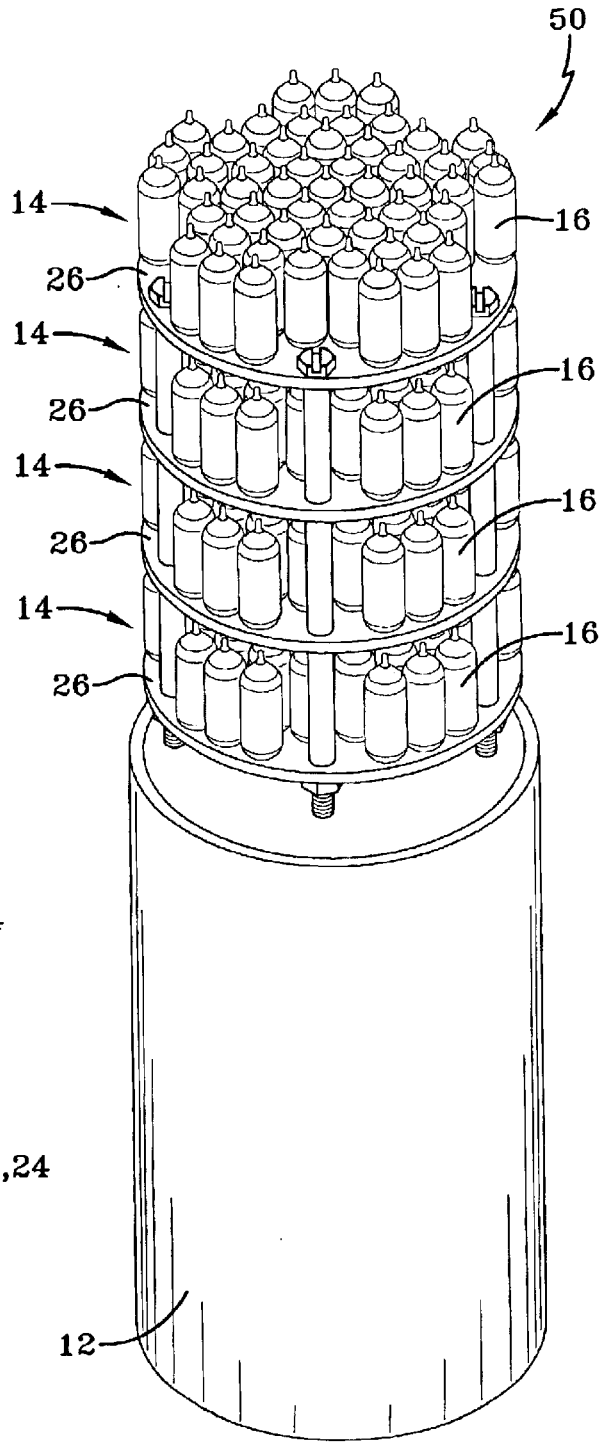
FIG. 6 is an exploded perspective view of a third embodiment.

While FIG. 1 shows one layer 14 of flash lamps 16, multiple layers stacked on top of each other may be used, as shown in FIG. 6. When more than one layer 14 of flashlamps 16 is used, each additional layer of flash lamps includes a centrally located flash lamp 20 that is electrically connected to the centrally located flash lamp 20 in the adjacent layer. Then, when the grenade is activated, the centrally located flash lamps 20 in each layer are electrically activated by the ignition circuit 18. The remaining flash lamps 16 in each layer 14 are sympathetically activated by the flash of the centrally located flash lamp 20 in each layer 14.

Referring now to FIG. 1, grenade 10 further includes base plate 26. Flash lamps 16 are mounted on base plate 26 by, for example, an interference fit in openings in plate 26. Housing 12 includes top and bottom end plates 28, 30. The variable time delay switch 24 is located adjacent bottom end plate 30. Grenade 10 further includes an activation switch 32 located on an external surface of the bottom end plate 30 for activating the grenade 10. The activation switch 32 is connected to the variable time delay switch 24. Activation switch 32 may be, for example, a push button switch.

The grenade 10 is assembled by installing a single ignition flashlamp 20 into the center position on base plate 26. The two electrical leads from the flashlamp 20 are soldered to the ignition circuit 18. The ignition circuit 18 and battery 22 are fixed to the base plate 26. The variable time delay switch is connected to the ignition circuit 18. The remaining supplemental lamps 16 are then installed. The assembled package is placed in the clear polycarbonate housing 12. An environmental seal of RTV or similar composition is placed around the ends of housing 12 prior to installation of the end plates 28, 30. While the end plates are held in position, the five (5) support screws 34 are installed and tightened. The environmental seal is allowed to cure for a minimum of eight (8) hours.

Figure 5:
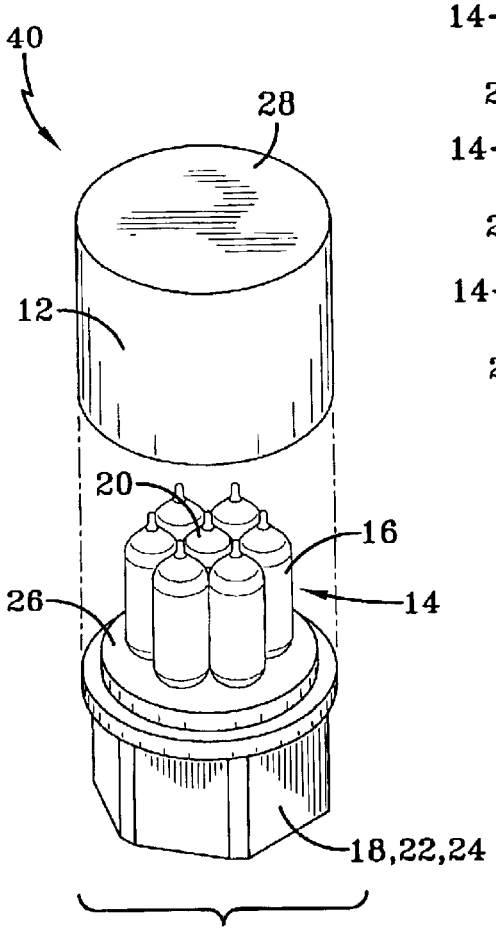
FIG. 5 is an exploded perspective view of a second embodiment.

FIG. 5 is an exploded perspective view of a second embodiment 40 of the invention. Grenade 40 includes a single layer 14 of seven lamps 16. FIG. 6 is an exploded perspective view of a third embodiment 50 showing four layers 14. In grenade 50, the number of flash lamps 16 per layer 14 is, for example, greater than fifty. Grenade 50 produces, for example, an illuminance of about 92,000 foot candles at a distance of about five feet from the grenade 50. Grenade 50 has a size about the same as a conventional twelve ounce soft drink can.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A non-lethal flash grenade, comprising:

a transparent, generally cylindrical housing;

a layer of flash lamps disposed in the housing;

an ignition circuit connected to a first centrally located flash lamp in the layer of flash lamps;

a battery connected to the ignition circuit; and a variable time delay switch connected to the ignition circuit;

whereby the first centrally located flash lamp is activated by the ignition circuit and remaining flash lamps are sympathetically activated by a flash of the first centrally located flash lamp.

2. The device of claim 1 further comprising at least one additional layer of flash lamps disposed in the housing, the at least one additional layer of flash lamps including a second centrally located flash lamp electrically connected to the first centrally located flash lamp; whereby the second centrally located flash lamp is electrically activated by the first centrally located flash lamp and remaining flash lamps in the at least one additional layer are sympathetically activated by a flash of the second centrally located flash lamp.

3. The device of claim 1 wherein a number of flash lamps is seven.

4. The device of claim 1 wherein the flash lamps comprise zirconium wool and oxygen.

5. The device of claim 2 wherein the flash lamps comprise zirconium wool and oxygen.

6. The device of claim 1 wherein the housing comprises polycarbonate.

7. The device of claim 2 further comprising base plates wherein each layer of flash lamps is mounted on a respective base plate.

8. The device of claim 1 wherein the housing includes top and bottom end plates, the variable time delay switch being disposed adjacent the bottom end plate, the device further comprising an activation switch located on an external surface of the bottom end plate, the activation switch being connected to the variable time delay switch.

9. The device of claim 1 wherein the variable time delay switch includes delay times in a range of about 0.5 seconds to about five minutes.

10. The device of claim 2 wherein a number of layers of flash lamps is three.

11. The device of claim 2 wherein a number of layers of flash lamps is four.

12. The device of claim 2 wherein a number of flash lamps per layer is greater than fifty.

13. The device of claim 2 wherein the device produces an illuminance of about 92,000 foot candles at a distance of about five feet from the device.

14. The device of claim 2 wherein a size of the device is about the same as a conventional twelve ounce soft drink can.

* * * * *